US006534906B1

(12) United States Patent
Kimura et al.

(10) Patent No.: US 6,534,906 B1
(45) Date of Patent: Mar. 18, 2003

(54) COLOR CATHODE RAY TUBE WITH TENSIONED SHADOW MASK

(75) Inventors: Masamichi Kimura, Takatsuki; Yoshikazu Demi, Gamo-gun; Shiro Kashihara, Moriyama, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/379,046

(22) Filed: Aug. 23, 1999

(30) Foreign Application Priority Data

Aug. 24, 1998 (JP) ..... 10-237660

(51) Int. Cl.[7] ..... H01J 29/07
(52) U.S. Cl. ..... 313/407; 313/403
(58) Field of Search ..... 313/402, 403, 313/408, 407

(56) References Cited

U.S. PATENT DOCUMENTS

| | | | | | |
|---|---|---|---|---|---|
| 4,186,326 | A | * | 1/1980 | Hosokoshi | 313/408 |
| 4,973,283 | A | | 11/1990 | Adler et al. | 445/30 |
| 4,973,879 | A | * | 11/1990 | Fujimura | 313/403 |
| 5,280,215 | A | * | 1/1994 | Ohtake et al. | 313/403 |
| 5,523,647 | A | | 6/1996 | Kawamura et al. | 313/407 |
| 5,681,197 | A | | 10/1997 | Egami et al. | 445/30 |
| 6,057,640 | A | * | 5/2000 | Aibara | 313/403 |
| 6,072,270 | A | * | 6/2000 | Hu et al. | 313/402 |

FOREIGN PATENT DOCUMENTS

| | | | | |
|---|---|---|---|---|
| JP | 48-85555 U | 10/1973 | | |
| JP | 57-12651 U | 1/1982 | | |
| JP | 58-147941 | 9/1983 | ..... | H01J/29/07 |
| JP | 58152349 A | 9/1983 | ..... | H01J/29/07 |
| JP | 58-181257 | 10/1983 | ..... | H01J/29/07 |
| JP | 61-177354 U | 11/1986 | ..... | H01J/29/07 |
| JP | 4-74818 | 11/1992 | ..... | H01J/29/07 |
| JP | 8-287841 | 11/1996 | ..... | H01J/29/07 |
| JP | 10040826 A | 2/1998 | ..... | H01J/29/07 |
| WO | WO 98/27573 | 6/1998 | ..... | H01J/29/07 |

OTHER PUBLICATIONS

Verified translation of Japanese Patent Office Official Gazette for Japanese Patent Application Laid–open No. Hei 4–74818, 2 pages.
Partial translation of JP 58–147941 A for IDS; undated; 1 page.
Partial translation of JP 48–85555 U for IDS; undated; 1 page.
Partial translation of JP 57–12651 U for IDS; undated; 1 page.
Partial translation of JP 61–177354 U for IDS; undated; 1 page.
Patent Abstracts of Japan, Publication No. 08287841; Nov. 01, 1996, 1 page.
European Search Report, Mar. 28, 2002, 3 pages.
Patent Abstracts of Japan, Publication No. 58181257 A, Oct. 22, 1983, 1 page.
Patent Abstracts of Japan, Publication No. 58147941 A, Sep. 02, 1983, 1 page.

* cited by examiner

*Primary Examiner*—Michael H. Day
(74) *Attorney, Agent, or Firm*—Rosenthal & Osha LLP

(57) ABSTRACT

The color cathode ray tube according to the present invention can improve the brightness without compromising strength by making the bridge width in one-dimensional tension type shadow mask narrower to a certain degree. The color cathode ray tube has a color selection electrode, the color selection electrode including a pair of supports facing each other; a shadow mask provided with a plurality of slot apertures, the shadow mask being stretched and fixed by the pair of supports; and elastic members arranged between the supports, and holding the supports. Bridges between vertically adjacent slot apertures are formed on the shadow mask. Defining the bridge width W as the largest vertical width of a bridge, the narrowest bridge width Wmin is in a range of 3–10% of a vertical pitch of the slot apertures. With this configuration, the necessary strength can be ensured, and the brightness can be improved without compromising strength, because the bridge widths W can be made narrower.

5 Claims, 6 Drawing Sheets

COLOR CATHODE RAY TUBE WITH TENSIONED SHADOW MASK

BACKGROUND OF THE INVENTION

1. Field of the Invention

The present invention relates to a shadow mask for a color cathode ray tube used in, for example, a television or a computer display. It relates in particular to a slotted shadow mask in which a plurality of slot apertures are formed in a flat panel as passing apertures for an electron beam.

2. Description of the Prior Art

FIG. 5 shows a cross-sectional view illustrating an example of a conventional color cathode ray tube. The color cathode ray tube 1 shown in this drawing includes a substantially rectangular face panel 2 on whose inner surface a phosphor screen 2*a* is formed, a funnel 3 connected to the rear side of the face panel 2, an electron gun 4 provided within a neck portion 3*a* of the funnel 3, a shadow mask 6 facing the phosphor screen 2*a* within the face panel 2, and a mask frame 7 fixing the shadow mask 6. In order to deflect and scan an electron beam, a deflection yoke 5 is provided on the peripheral surface of the funnel 3.

The function of the shadow mask 6 is to select colors so that the three electron beams emitted from the electron gun 4, each corresponding to one color, reach the luminescent material of the corresponding color on the phosphor screen 2*a*. "A" illustrates a trajectory of the electron beam. The following is an explanation of a slotted shadow mask as a conventional example of the shadow mask 6. In the slotted shadow mask, a plurality of substantially rectangular slot apertures are formed in a flat panel, by etching, as passing apertures for the electron beams.

FIG. 6 shows a part of a top view illustrating an example of the slotted shadow mask. In this figure, the arrow direction x indicates the horizontal screen direction, and the arrow direction y indicates the vertical screen direction. The slot apertures 8 are formed with constant vertical pitch. The portion 9 between the slot apertures 8 is called a "bridge".

The bridge width affects the mechanical strength of the shadow mask. When the bridge is made narrower, the shadow mask becomes vulnerable to horizontal tension in particular. When the bridge is made wider to improve the mechanical strength, the brightness decreases due to the smaller area of the slot apertures.

Publication of Japanese Unexamined Patent Application (Tokkai) No. Hei 10-40826 suggests that, to achieve both brightness and mechanical strength of shadow mask, a certain numerical relationship is defined between the length of the portion of the bridge that has not been etched and that is common to the front and the back surface (that is, the region where neither the front nor the back of the shadow mask has been etched, and where the shadow mask retains its original thickness), and the vertical pitch of the slot apertures. Also, Publication of Japanese Examined Patent Application (Tokko) No. Hei 4-74818 discloses an improvement of the mechanical strength by making the bridges at a peripheral portion of the shadow mask wider than those of a central portion because of the stress concentrations in the peripheral portions of the shadow mask in the molded mask made by press forming.

However, shadow masks of conventional color cathode ray tubes as explained above lead to the following problems:

(1) Considering the mechanical strength of the shadow mask, the bridge requires portions that have not been etched and that are common to the front and the back surface. Therefore there is a certain limit to how narrow the bridge can be made and how much the brightness can be improved. In addition, when the bridges in the peripheral portion of the shadow mask are made wider than those in the central part, the mechanical strength improves, but the brightness at the peripheral portion decreases.

(2) The phosphors are arranged in stripes. Therefore, when the shape of slot apertures is round, the shape of the electron beam also becomes round when it has passed the slot aperture. This is not preferable with regard to improving the brightness. In addition, shaking of the shadow mask due to shock causes misalignment of the electron beam. In this case, there is a significant change in brightness and color purity.

SUMMARY OF THE INVENTION

In order to solve these problems, it is an object of the present invention to provide a color cathode ray tube with a one-dimensional tension type shadow mask, which is stretched applying a tension to one direction, and whose bridges are made narrower to a certain degree, thus improving the brightness without compromising the strength of the shadow mask.

In order to achieve the object mentioned above, a color cathode ray tube according to the present invention has a color selection electrode, the color selection electrode including a pair of supports facing each other; a shadow mask provided with a plurality of slot apertures, the shadow mask being stretched and fixed by the pair of supports; and elastic members arranged between the supports, and holding the support. Bridges between vertically adjacent slot apertures are formed on the shadow mask. Defining "bridge width" as the largest vertical width of a bridge, the narrowest bridge width is in a range of about 3–10% of a vertical pitch of the slot apertures. With such a color cathode ray tube, the necessary strength can be ensured, and the brightness can be improved without compromising strength, because the bridge widths can be made narrower.

It is preferable that bridges having bridge width in the range of 3–10% of the vertical pitch of the slot aperture include bridges having maximum thickness less than that of the shadow mask. With such a color cathode ray tube, there are no bridge portions that have not been etched and that are common to the front and the back surface, so that the bridge width can be made as narrow as possible.

It is preferable that the maximum thickness of the bridge having maximum thickness less than that of the shadow mask is at least 50% and less than 100% of the thickness of the shadow mask.

It is preferable that the slot apertures are substantially rectangular. With such a shape, the shape of the electron beam after it has passed the slot apertures is substantially rectangular as well, so that the necessary brightness can be ensured, and the image deterioration due to shaking of the shadow mask can be reduced.

It is preferable that the relationship $a/b > 1.8$ is satisfied, wherein "a" is half the horizontal width of one of the slot apertures, and "b" is the height of a curved portion formed on upper and lower edges of one of the slot apertures in a vertical direction.

It is preferable that the bridge widths in a central portion of the shadow mask are substantially the same as the bridge widths in a peripheral portion of the shadow mask, or the bridge widths in the peripheral portion of the shadow mask are narrower than the bridge widths in the central portion of the shadow mask. With such an arrangement, a decrease of the brightness in the peripheral portion can be prevented.

DESCRIPTION OF THE PREFERRED EMBODIMENTS

Figure 5:
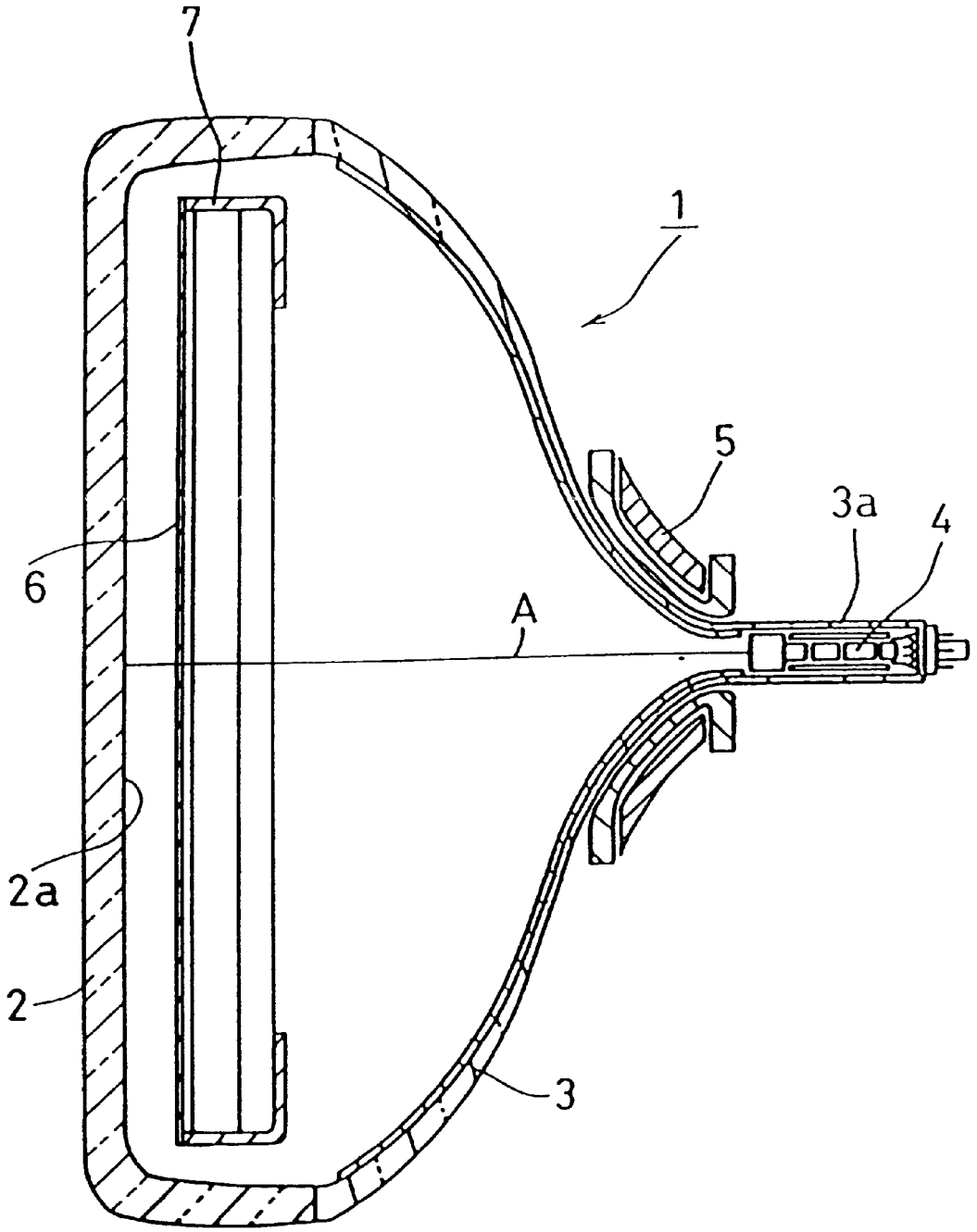
FIG. 5 Prior Art
FIG. 5 shows a cross-sectional view illustrating an example of a conventional color cathode ray tube.
Figure 6:
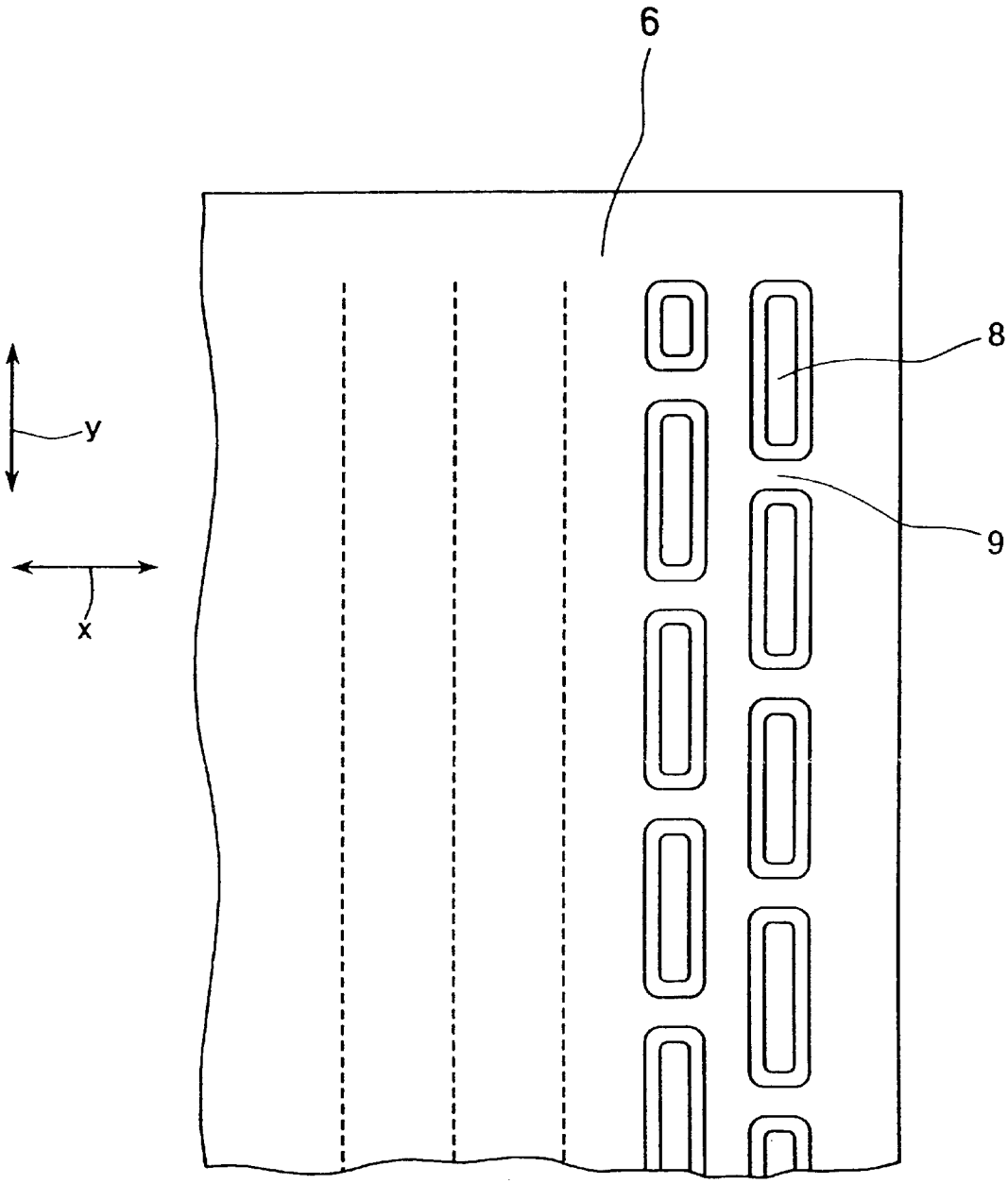
FIG. 6 Prior Art
FIG. 6 shows a top view illustrating a conventional example of a relationship between slot apertures and bridges.

The following is a detailed description of an embodiment of the present invention. Since the general configuration of the color cathode ray tube of the present embodiment is the same as that explained in FIG. 5, further explanations have been omitted. The present invention relates to a one-dimensional tension type shadow mask. First, the one-dimensional tension type is explained in the following.

In color cathode ray tubes, if the through holes for passing the electron beam are displaced due to thermal expansion of the shadow mask, caused by the absorption of the electron beam, the electron beam passing these apertures in the shadow mask does not hit the phosphors correctly, which can lead to color irregularities. This phenomenon is called "doming". Therefore, the shadow mask is retained in a mask frame, which applies a tension to the shadow mask that can absorb the thermal expansion due to temperature rises in the shadow mask.

Figure 1:
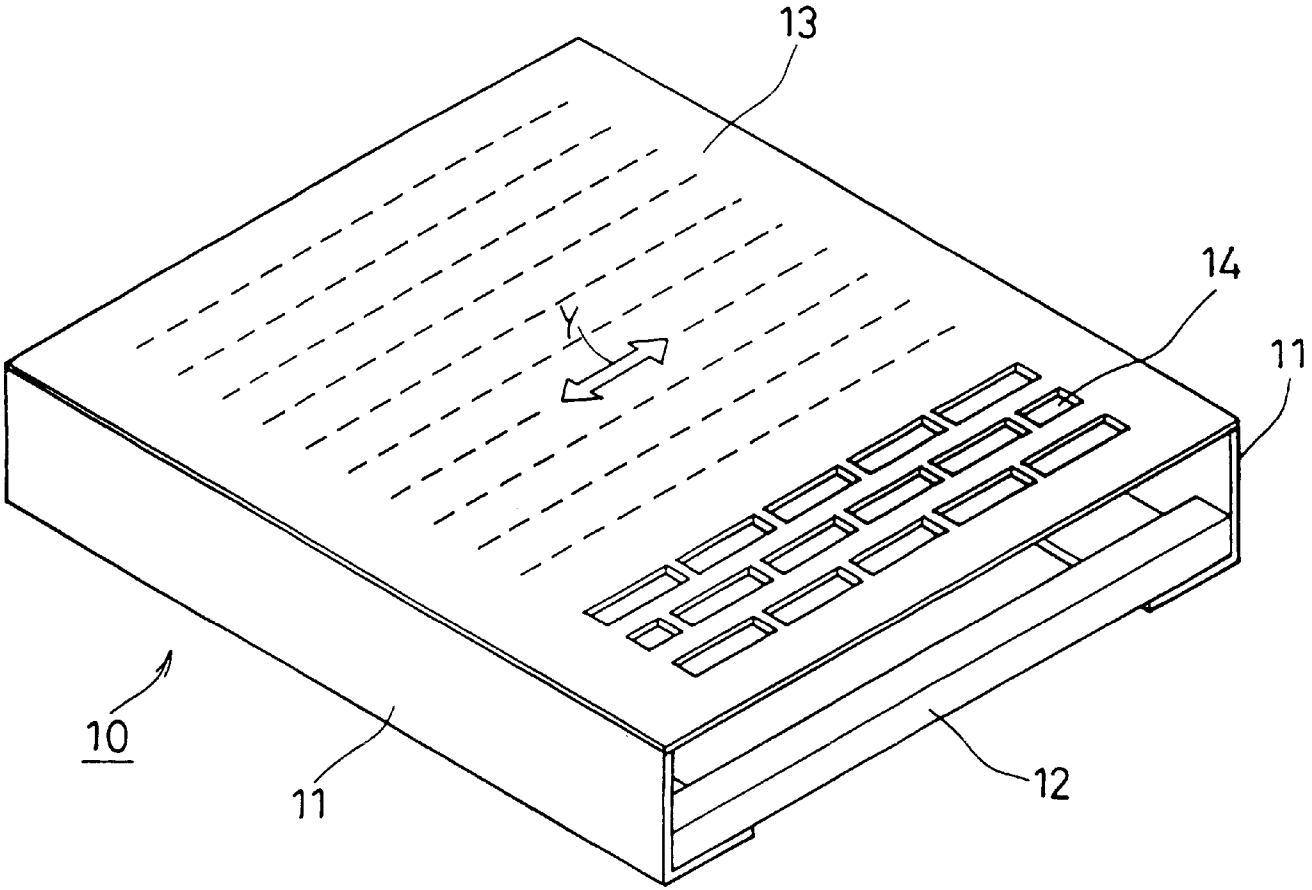
FIG. 1 shows a perspective view illustrating one embodiment of a color selection electrode according to the present invention.

FIG. 1 is a perspective view illustrating an example of a color selection electrode. A rectangular mask frame 10 includes a pair of supports 11 that oppose each other and form the long sides of the frame. A pair of elastic members 12 that oppose each other and form the short sides of the frame is fixed to the supports 11. There is no particular restriction to form, shape, or material of the elastic members 12. The elastic members 12 can be made, for example, of a metal, such as steel. In a shadow mask 13, a plurality of slot apertures 14, which are substantially rectangular slotted apertures for passing electron beams, are formed by etching. For the shadow mask 13 shown in FIG. 1, a one-dimensional tension system is adopted, and the shadow mask 13 is stretched and fixed by the supports 11, with a tension force applied in the arrow direction Y.

Stretching the shadow mask like this can prevent misalignments between the relative positions of the slot apertures 14 in the shadow mask 13 and phosphor stripes on the phosphor screen, when the temperature of the shadow mask 13 rises. Besides the one-dimensional tension system mentioned above, there are also two-dimensional tension systems for stretching the shadow mask. "One-dimensional tension system" refers to systems that apply a tension only to the vertical screen direction of the shadow mask as described above, while "two-dimensional tension system" refers to systems that apply a tension to both the vertical and horizontal screen directions.

The present invention recognizes the following features of the one-dimensional tension type shadow mask. In the one-dimensional tension type shadow mask, a tension force is applied primarily in the vertical direction, but a slight tension force is also applied in the horizontal screen direction in addition to the vertical screen direction. Poisson's ratio $\nu(\nu=|\epsilon'/\epsilon|)$, which indicates the relationship between the vertical strain $\epsilon$ and the horizontal strain $\epsilon'$ is small in a metallic material. Specifically, in one-dimensional tension systems, tensile stress in the horizontal screen direction is not greater than 10 kg/mm$^2$. For example, in 29-inch cathode ray tubes, when a total tension of 200 kg is applied more or less evenly distributed to a shadow mask, the tensile stress in the horizontal bridge direction is approximately 10 kg/mm$^2$.

In addition, the yield point of a metallic material used for shadow masks is 20–70 kg/mm$^2$. Therefore, when a stress of not greater than about 10 kg/mm$^2$ is applied in the horizontal direction, a sufficient safety factor is ensured, and there is no concern that the bridges might break. Thus, in a one-dimensional tension system shadow mask, it is not necessary to provide bridges with large widths to prevent them from breaking.

Figure 2:
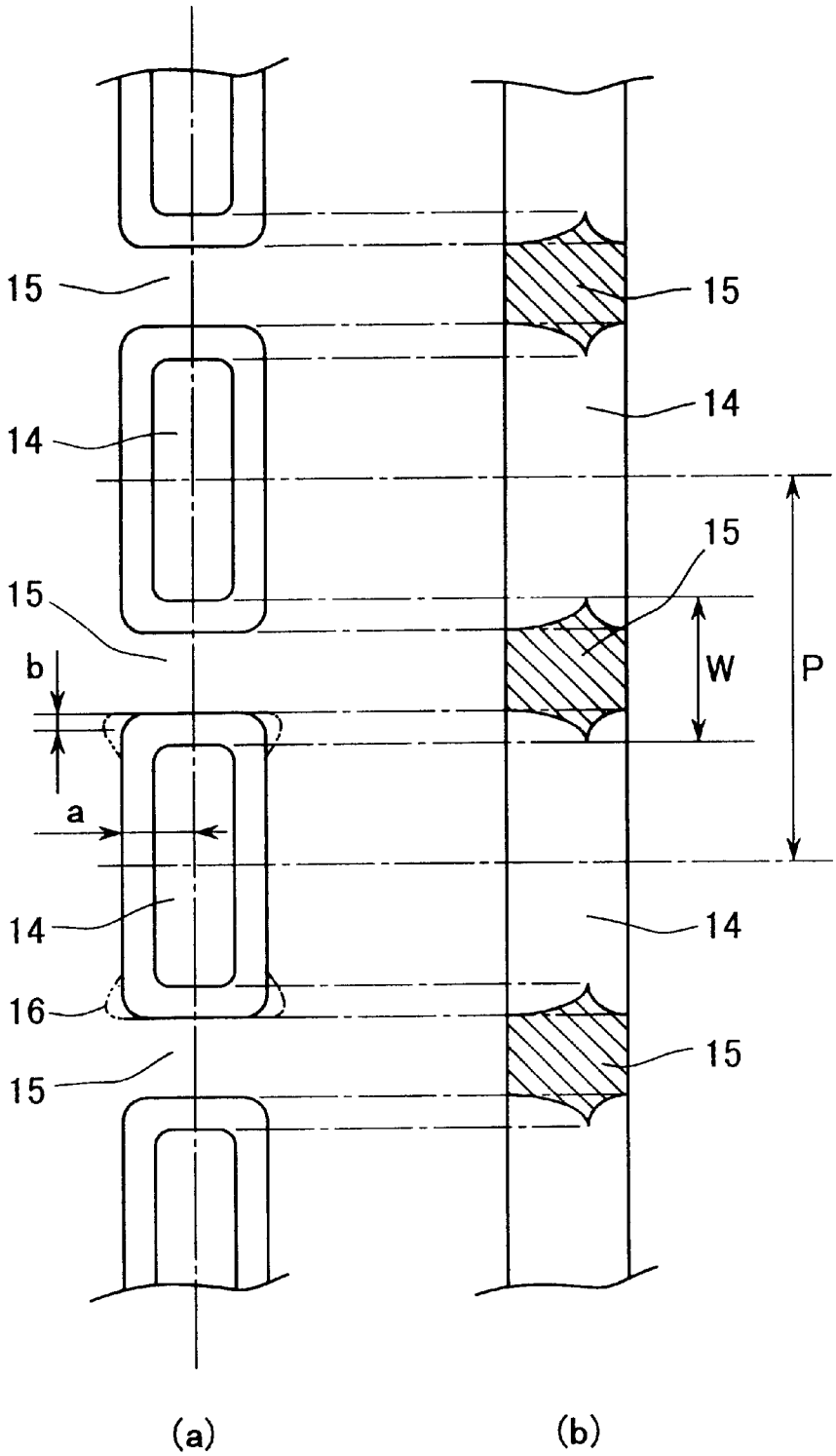
FIG. 2 shows the bridge shape in an embodiment of the present invention.

FIG. 2(*a*) shows a top view of slot apertures 14 adjacent to each other in the vertical screen direction in a shadow mask according to the present embodiment. FIG. 2(*b*) shows a sectional view along the vertical direction of FIG. 2(*a*). The portions between the slot apertures 14 adjacent to each other in the vertical screen direction are bridges 15. "P" indicates the vertical pitch of the slot apertures, and "W" indicates the bridge width. As shown in FIG. 2(*b*), the bridge width W is the largest width in the vertical screen direction.

Defining Wmin as the bridge width of the narrowest bridge, in the present embodiment (Wmin/P)×100 is in the range of about 3–10%. For example, in an embodiment where P≈650 $\mu$m and Wmin=25–50 $\mu$m, neither bridge breaking nor other problems such as wrinkles occurred. In this case, the thickness of the shadow mask was 100 $\mu$m.

Figure 3:
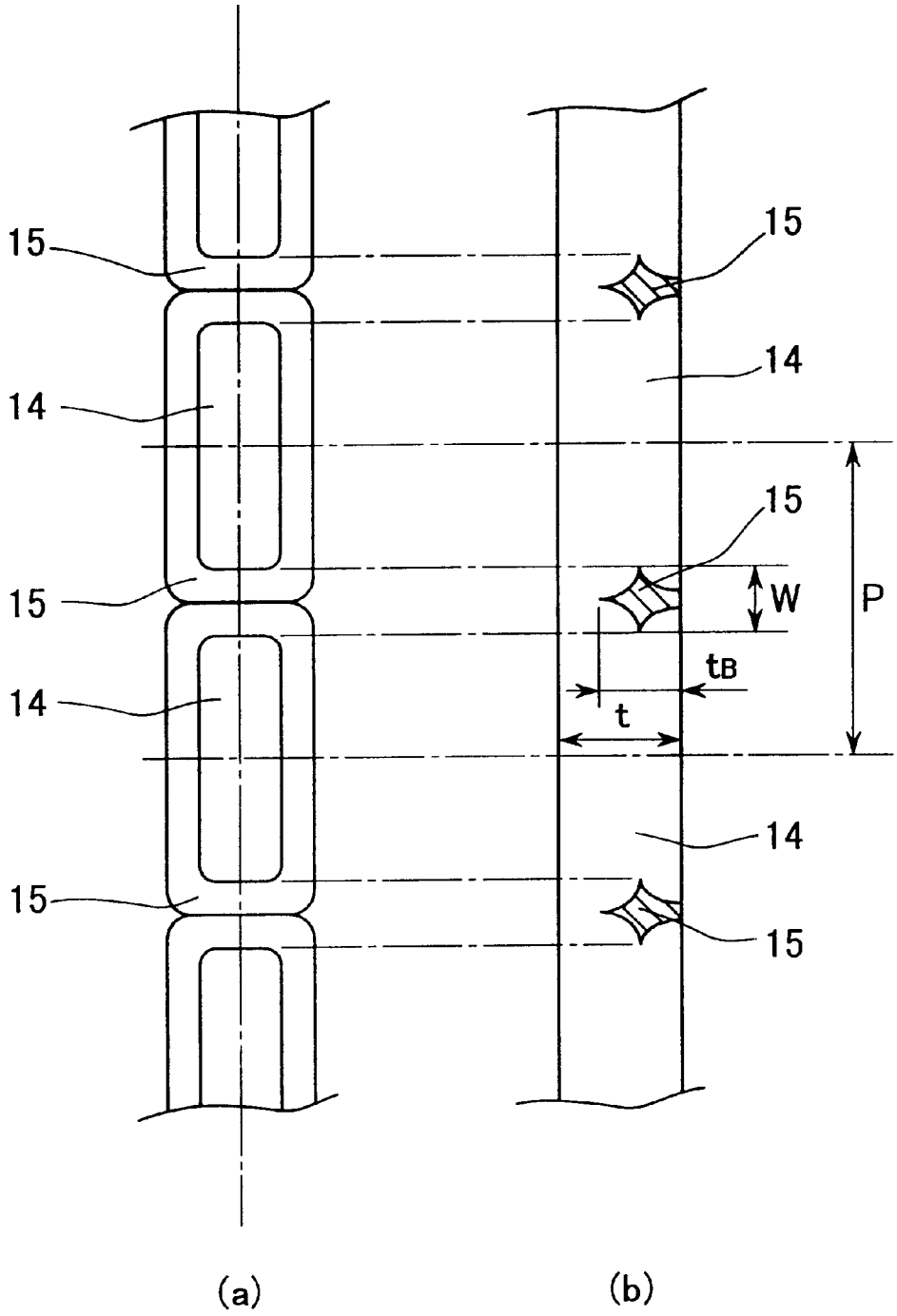
FIG. 3 shows the bridge shape in another embodiment of the present invention.
Figure 4:
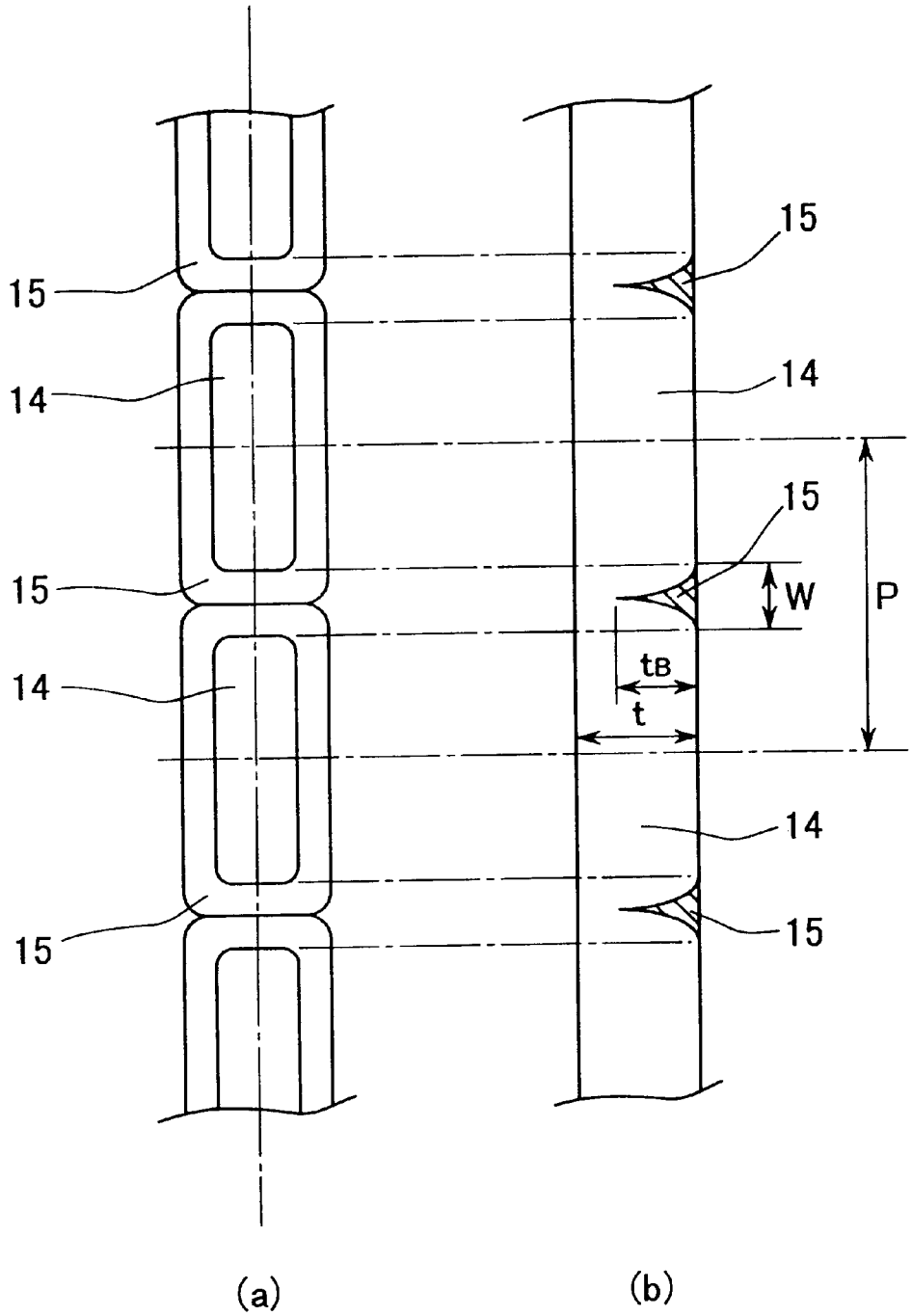
FIG. 4 shows the bridge shape in yet another embodiment of the present invention.

Also, in order to make (Wmin/P)×100 fall within the range of 3–10%, the maximum thickness of the bridges may be smaller than that of the shadow mask. FIGS. 3 and 4 show embodiments of such slot apertures. FIG. 3(*a*) and FIG. 4(*a*) are top views, and FIG. 3(*b*) and FIG. 4(*b*) are sectional views along the vertical direction.

When a portion of the bridge keeps the original thickness of the shadow mask, that is, when there is a portion that has not been etched and that is common to the front and the back surface, there is a certain limit of how narrow the bridge can be made, since the bridge is at least as wide as the portion that has not been etched and that is common to the front and the back surface. By making the maximum thickness of the bridge smaller than that of the shadow mask, in other words, by eliminating the portion that has not been etched and that is common to the front and the back surface, the bridge can be made still narrower.

For instance, as is shown in FIG. 3(*b*) and FIG. 4(*b*), denoting the thickness of the shadow mask by t and the maximum thickness of the bridge by $t_B$, neither bridge breaking nor other problems such as wrinkles arose when $(t_B/t)\times100$ was at least 50%. In this case, the thickness of the shadow mask was 100 $\mu$m and the vertical pitch P was approximately 650 $\mu$m.

It is preferable that the shape of the slot apertures is substantially rectangular. This is because it is disadvantageous with regard to ensuring brightness if the slot apertures are round, since the phosphor layer is arranged in stripes. In addition, if the slot apertures are round, the change in brightness and color purity becomes significant when a shadow mask moves due to shaking, for example due to shock.

More specifically, it is preferable that the slot aperture's geometry satisfies the relationship of a/b >1.8, wherein "a" denotes half of the slot aperture's width, and "b" denotes the height of the curved portion formed on the upper and lower edges of a slot aperture in the vertical direction, as is shown in FIG. 2(*a*).

Here, "curved portion formed on the upper and lower edges of a slot aperture in the vertical direction" refers to the curved portion at the corner of the slot apertures which connects a straight section on the vertical side with a straight section on the horizontal side of the slot apertures. A "height of the curved portion" refers to the direct distance from an intersection between a straight section on the vertical side and a curved portion to an intersection between the extension of a straight section on the vertical side and the extension of a straight section on the horizontal side.

Satisfying this relationship makes the shape of the electron beam after it has passed the slot aperture substantially rectangular, thus ensuring the necessary brightness. In addition, even when the shadow mask is shaken and the electron beam shifts away from the phosphor stripes in the horizontal direction, the deterioration of the color purity can be reduced because the range of phosphors excited by the beam does not change easily.

The shape of the slot apertures can be made substantially rectangular, as explained above, by making the upper and lower edges of the exposure pattern for the slot apertures bulge outward. FIG. 2(*a*) shows an example of this. The double-dashed line 16 corresponds to the bulging portion at the upper and lower edges of an exposure pattern for the slot apertures.

In a conventional molded mask made by press forming, stress concentrates on the peripheral portions of the shadow mask, therefore bridges in the peripheral portion had to be made wider than those in the central portion. With such a conventional shadow mask, the mechanical strength could be improved, but the problem arose that the brightness in the peripheral portion was reduced.

Compared with molded masks and two-dimensional tension type shadow masks, a one-dimensional tension type shadow mask is subject to lower stress concentrations on the bridges in the peripheral portion of the shadow mask, so that there are less restrictions with regard to the mechanical strength of the bridges that has to be ensured. Thus, it is preferable that the bridge width in the central and peripheral portions of the shadow mask is the same, or that the bridges in the peripheral portion are narrower than those in the central portion. By adopting these relationships, the brightness in the peripheral portion can be ensured as well.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color cathode ray tube having a color separation electrode, the color separation electrode comprising:

a pair of supports facing each other;

a shadow mask provided with a plurality of slot apertures, said shadow mask being stretched in a state in which a tension force is applied in the vertical direction and fixed by said pair of supports; and elastic members arranged between said support, and holding said supports;

wherein bridges connecting vertically adjacent slot apertures are formed on said shadow mask, each bridge having a bridge width, the narrowest bridge width is in a range of approximately 3–10% of a vertical pitch of the slot apertures, wherein each bridge having a bridge width in the range of 3–10% of the vertical pitch of the slot aperature comprise a maximum thickness less than that of said shadow mask, and wherein the maximum thickness is at least 50% and less than 100% of the thickness of said shadow mask.

2. The color cathode ray tube according to claim 1, wherein the slot apertures are substantially rectangular.

3. The color cathode ray tube according to claim 2, satisfying the relationship a/b >1.8, wherein "a" is half the horizontal width of one of the slot apertures, and "b" is the direct distance from an intersection between a straight section on the vertical side and a curved portion to an intersection between the extension of a straight section on the vertical side and the extension of a straight section on the horizontal side of a curved portion formed on upper and lower edges of one of the slot apertures in a vertical direction and connecting a straight section on the vertical side with a straight section on the horizontal side of the slot apertures.

4. The color cathode ray tube according to claim 1, wherein the bridge widths in a central portion of the shadow mask are substantially the same as the bridge widths in a peripheral portion of the shadow mask.

5. The color cathode ray tube according to claim 1, wherein the bridge widths in a peripheral portion of the shadow mask are narrower than the bridge widths in a central portion of the shadow mask.

* * * * *